US007252450B2

(12) United States Patent
Aguirre et al.

(10) Patent No.: US 7,252,450 B2
(45) Date of Patent: Aug. 7, 2007

(54) WRITING INSTRUMENT HOLDING AND RETAINING DEVICE

(76) Inventors: Mario Ramirez Aguirre, 12802 Zanja St., Los Angeles, CA (US) 90066; Tim Aoki, 5216 Proctor Ave., Oakland, CA (US) 94618

( * ) Notice: Subject to any disclaimer, the term of this patent is extended or adjusted under 35 U.S.C. 154(b) by 242 days.

(21) Appl. No.: 10/826,824

(22) Filed: Apr. 16, 2004

(65) Prior Publication Data

US 2005/0232682 A1 Oct. 20, 2005

(51) Int. Cl.

| | |
|---|---|
| ***A46B 5/02*** | (2006.01) |
| ***B43K 23/02*** | (2006.01) |
| ***B43K 25/00*** | (2006.01) |
| ***A45F 5/00*** | (2006.01) |

(52) U.S. Cl. ..... 401/131; 401/8; 224/267; 24/10 R

(58) Field of Classification Search ..... 401/8, 401/48, 52, 131, 195; 24/10 R, 11 R, 11 M; 224/267

See application file for complete search history.

(56) References Cited

U.S. PATENT DOCUMENTS

| | | | | |
|---|---|---|---|---|
| 1,322,862 | A * | 11/1919 | Ziporyn | 401/6 |
| 1,367,433 | A * | 2/1921 | Shackitt | 401/268 |
| 1,462,108 | A * | 7/1923 | Holywell | 211/69.5 |
| 1,577,272 | A * | 3/1926 | Treadaway | 242/379.2 |
| 2,502,680 | A * | 4/1950 | Stewart | 177/129 |
| 5,140,723 | A | 8/1992 | Genzel | |
| 6,435,749 | B1 | 8/2002 | Lecce | |
| 6,499,899 | B2 | 12/2002 | Sawyer | |

* cited by examiner

*Primary Examiner*—David J. Walczak

(57) ABSTRACT

A writing instrument holding and retaining device comprising a wristband/bracelet (22) with one or more fasteners (24), a tether/leash (26), and a writing instrument holder (32) securing a writing instrument (30). The tether connects the writing instrument holder to the wristband. The wristband and tether may be constructed of any suitable material and may vary depending on design and aesthetic preferences. The writing instrument may also have an appropriate fastener (36). The fasteners on the wristband and on the writing instrument must be able to be attached together to secure the writing instrument to the wristband when the writing instrument is not in use. The tether (26) may also have a fastener (28), so that the tether may be kept from dangling when not in use by attaching the tether's fastener to one of the fasteners on the wristband. For each of the fasteners mentioned above (wristband, writing instrument, and tether), any suitable fastener or fastening method may be used, for example, a clip, magnet, or Velcro.

1 Claim, 9 Drawing Sheets

WRITING INSTRUMENT HOLDING AND RETAINING DEVICE

CROSS-REFERENCE TO RELATED APPLICATION

Not Applicable

FEDERALLY SPONSORED RESEARCH

Not Applicable

SEQUENCE LISTING OR PROGRAM

Not Applicable

BACKGROUND OF THE INVENTION—FIELD OF INVENTION

This invention relates to personal writing instrument holders.

BACKGROUND OF THE INVENTION

Writing instruments, such as pens, pencils, chalk, markers, and the like, are used millions of times per day all over the world. Writing instruments are valuable tools of daily life, but they are easily misplaced. As a result, people in busy environments, such as teachers, students, professionals, and waiters, are constantly losing their pens or pencils. This is a problem that is a constant source of frustration and can result in lost productivity.

Both U.S. Pat. No. 5,140,723 to Genzel, 1992 Aug. 25, and U.S. Pat. No. 6,435,749 to Lecce, 2000 Aug. 20, secure a writing instrument on a bracelet. However, the writing instrument is still vulnerable to loss when not secured to the bracelet. Also, because the writing instrument may only be secured to the bracelet in one position, the user is required to carefully align the writing instrument in order to secure it from loss. In practice, aligning the writing instrument in this manner can be awkward, and reduces flexibility and ease of use.

U.S. Pat. No. 6,499,899 to Sawyer, 2002 Dec. 31, secures a writing instrument with a retractable mechanism in a housing so that if the writing instrument is dropped, the writing instrument will retract to the housing. However, the housing and mechanism are elements that are relatively expensive and may be complicated to manufacture. Also, although the housing is intended to be attached to the user's clothing, it can be relatively bulky, obtrusive, and not conducive to a stylish design that a user would actually be willing to wear. Finally, many people, while thinking about what to write, will often rotate their handheld writing instruments between their fingers. This can be a conscious activity, or a nervous habit. In any event, U.S. Pat. No. 6,499,899 to Sawyer, 2002 Dec. 31, does not accommodate a user's rotating his or her writing instrument.

BACKGROUND OF THE INVENTION—OBJECTS AND ADVANTAGES

Several objects and advantages of the present invention are:

(a) to provide a device which eliminates the everyday loss of writing instruments by keeping a writing instrument tethered to a user's wrist by means of a tether connected to a wristband, so that the writing instrument cannot be lost or misplaced;

(b) to provide a device which permits the user to quickly and easily secure both the writing instrument and its tether to the wristband by means of a temporary attachment device, such as Velcro or a magnet, so that the writing instrument and its tether may be neatly stowed while remaining readily at hand for future uses;

(c) to provide a device which permits the writing instrument to be secured to the wristband in multiple positions, to allow flexibility and ease of use;

(d) to provide a device which is relatively inexpensive to manufacture because it has a fixed-length tether and does not require a retraction mechanism or housing;

(e) to provide a device which is relatively unobtrusive, conducive to stylish design, and that a user would most likely want to actually wear;

(f) to provide a device which accommodates a user's conscious or unconscious rotation of his or her writing instrument.

Our invention prevents loss of a writing instrument by tethering it to a user's wristband, and permits the writing instrument and its tether to be temporarily secured to the wristband when not in use. Our invention also allows the user to playfully rotate his or her writing instrument if desired, and does not require the user to adopt awkward movements or to attach a bulky or unstylish device to his or her clothing.

Insofar as we are aware, no invention to date both prevents loss of a writing instrument and keeps the writing instrument readily at hand, while also being easy to use, simple and inexpensively manufactured, functional yet unobtrusive and stylish in design, and accommodating users' conscious and unconscious habit of rotating their pens and pencils between their fingers.

Further objects and advantages of our invention will become apparent from a consideration of the drawings and ensuing description.

SUMMARY

The present invention is a writing instrument holding and retaining device comprising a wristband; a tether attached to the wristband on one end and to a writing instrument holder securing a writing instrument on the other end; and a fastener, such as a hook and loop fasener, i.e., VELCRO or a magnet, that will secure the writing instrument to the wristband when the writing instrument is not in use. The tether may also be equipped with a similar fastener to secure the tether to the wristband, so that the tether will not dangle when the writing instrument is not in use. Because the writing instrument is tethered to the wristband, the user cannot subconsciously misplace or lose the writing instrument, and the writing instrument is always readily available for use.

DRAWINGS—FIGURES

In the drawings, closely related Figures have the same number but different alphabetic suffixes.

DRAWINGS—REFERENCE NUMERALS

Figure 1:
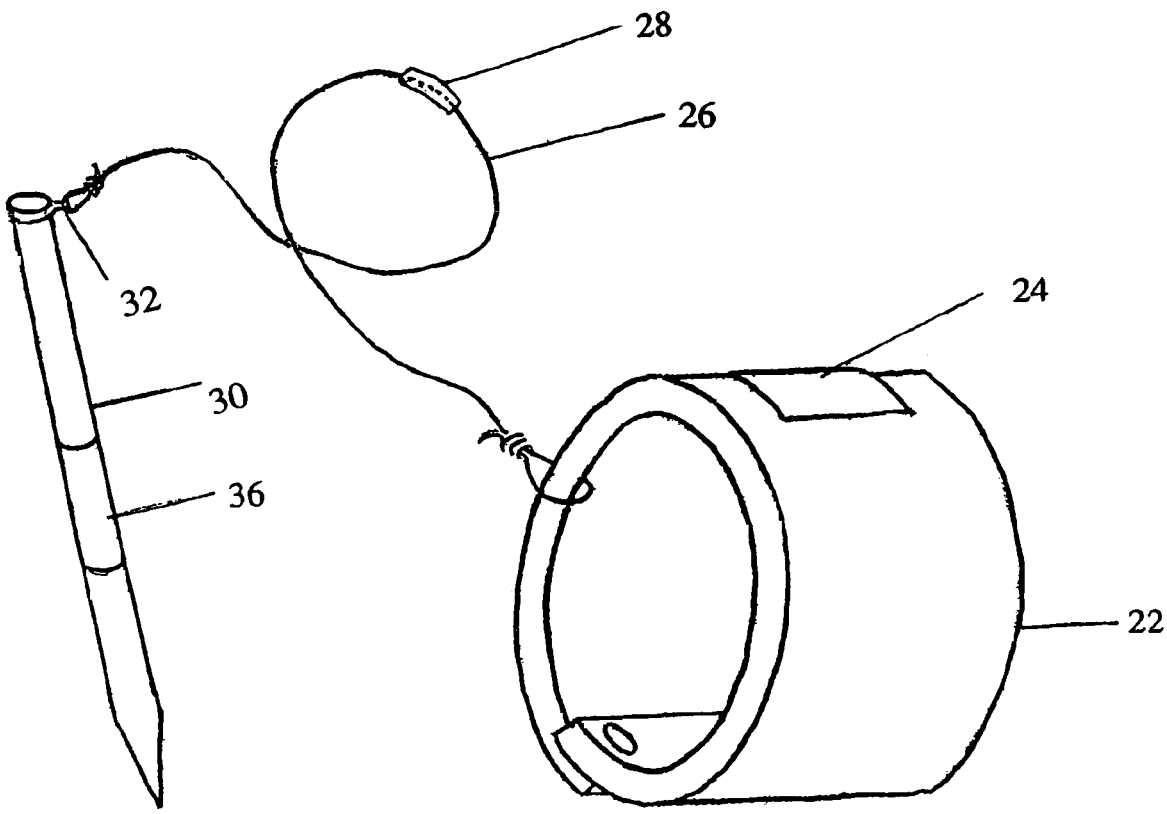
FIG. 1 illustrates a preferred embodiment of the present invention, a writing instrument holding and retaining device.

22 wristband
24 fastener (on wristband 22)
26 tether/leash
28 fastener (on tether 26)
30 writing instrument
31 writing instrument for alternative embodiment
32 writing instrument holder
34 screw top
36 fastener (on writing instrument 30)
38 anchor (for tether 26 to wristband 22)
40 attachment point for tether
42 ring
44 flanges on writing instrument holder
46 set screw
48 cylindrical clamp
50 writing instrument holder—preferred embodiment
52 cylinder
54 attachment point for tether 26
56 clamp screw
58 clamp
60 screw housing

DETAILED DESCRIPTION—FIGS. 1, 3, 4, 5, 6, AND 7—PREFERRED EMBODIMENT

FIG. 1 illustrates the present invention, a writing instrument holding and retaining device comprising a wristband 22 (which will vary depending on design and aesthetic preferences) with one or more fasteners 24 (such as, for example, a clip, magnet, or a hook and loop fasener, i.e., VELCRO), a tether/leash 26, and a writing instrument 30. Tether 26 connects writing instrument 30 to wristband 22. Writing instrument 30 may be enveloped by an appropriate fastener 36. Fasteners 24 (on the wristband) and 36 (on the writing instrument) must be compatible, so that they can be attached together to secure the writing instrument to the wristband in a plurality of orientations and angles when not in use. Tether 26 may also have a fastener 28, so that the tether may be kept from dangling when not in use by attaching fastener 28 to one of the fasteners 24 on the wristband.

a. Tether

Figure 1B:
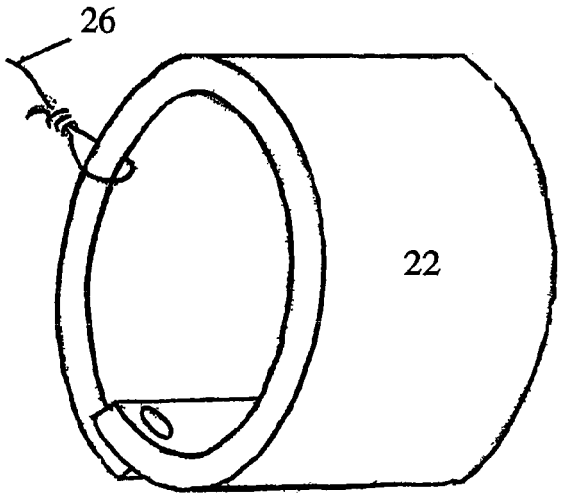
FIG. 1B illustrates an alternative method for anchoring the tether to the wristband with a knot.
Figure 1C:
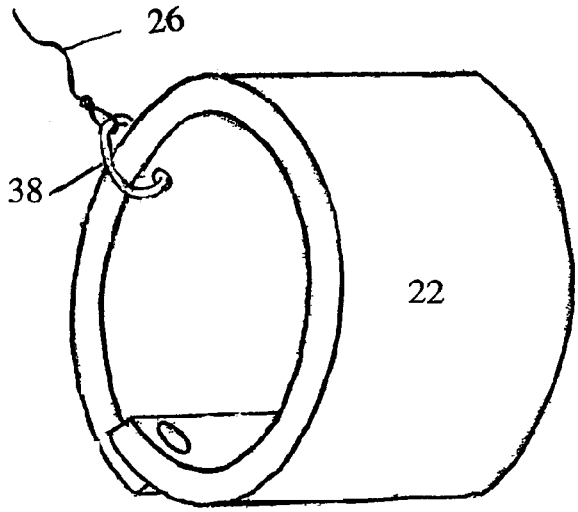
FIG. 1C illustrates an alternative method for anchoring the tether to the wristband with a key ring-like mechanism.
Figure 1A:
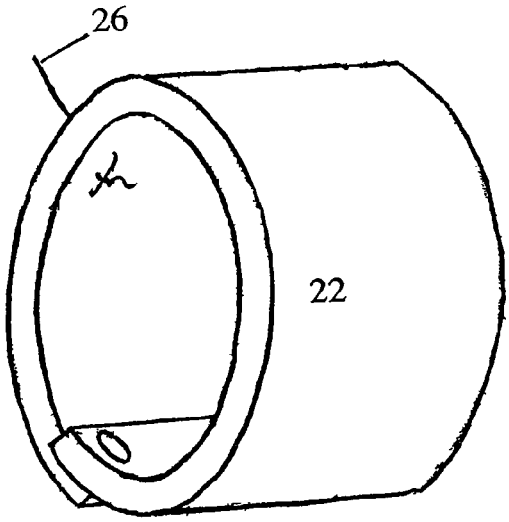
FIG. 1A illustrates an alternative method for anchoring the tether to the wristband with a staple.
Figure 3:
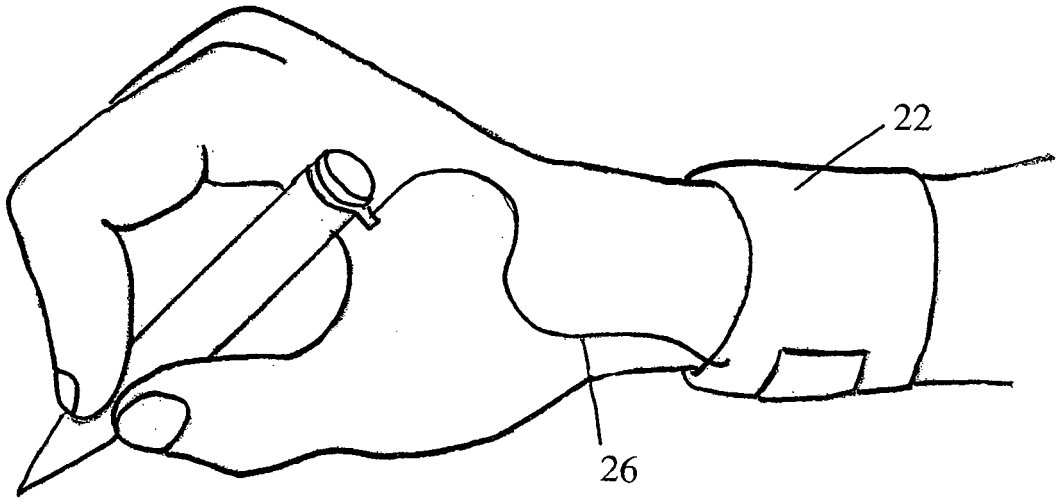
FIG. 3 illustrates the present invention, as it would appear while a writing instrument is in use.
Figure 4:
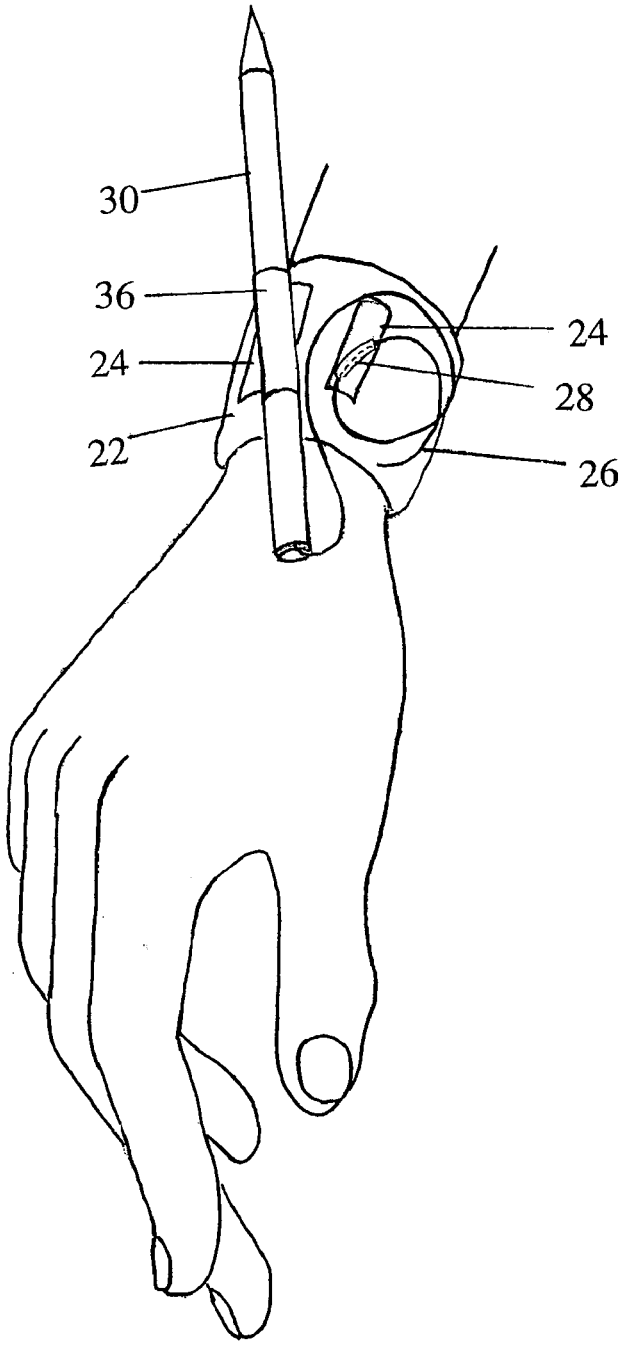
FIG. 4 illustrates the present invention, as it would appear while the writing instrument is not in use.

Tether 26 loops through a ring 38 (and then can be fastened to the ring like a noose) which is anchored to wristband 22. Alternatively, as shown in FIGS. 1A and 1B, tether 26 can run through a hole in wristband 22 and be anchored to the wristband from the inside by something as simple as a knot and/or staple. (The knot is shown in FIG. 1B; the staple is shown in FIG. 1A.) Alternatively, a key ring-like mechanism can be used to secure the tether to the wristband (the key ring-like mechanism is shown in FIG. 1C. As shown in FIGS. 1, 3 and 4, the location of the attachment of tether 26 to wristband 22 is preferably towards the edge of the wristband closest to the wristband wearer's fingers (as this will decrease the need for a longer tether). The manner in which tether 26 is connected to wristband 22 may vary depending on design and aesthetic preferences.

Tether 26 can be made of any suitable material, including leather, string, cloth, fabric, chain, and/or plastic. The tether runs from wristband 22 to a writing instrument holder 32 that can secure a wide range of writing instruments. Tether 26 may or may not be retractable.

b. Writing Instrument Holder

Figure 5:
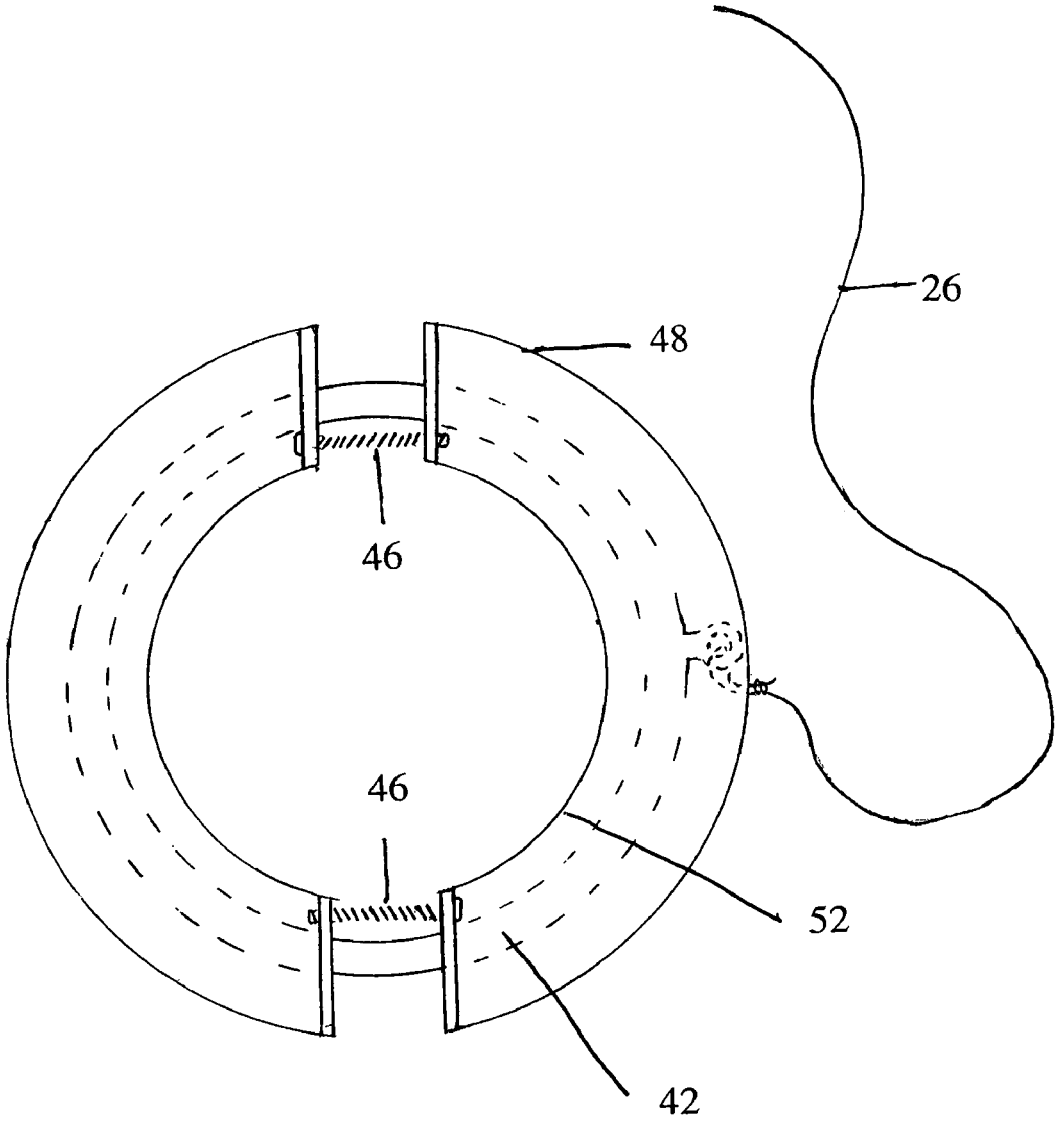
FIG. 5 illustrates another option for a writing instrument holder, a cylindrical clamp. It is shown from a top view.
Figure 6:
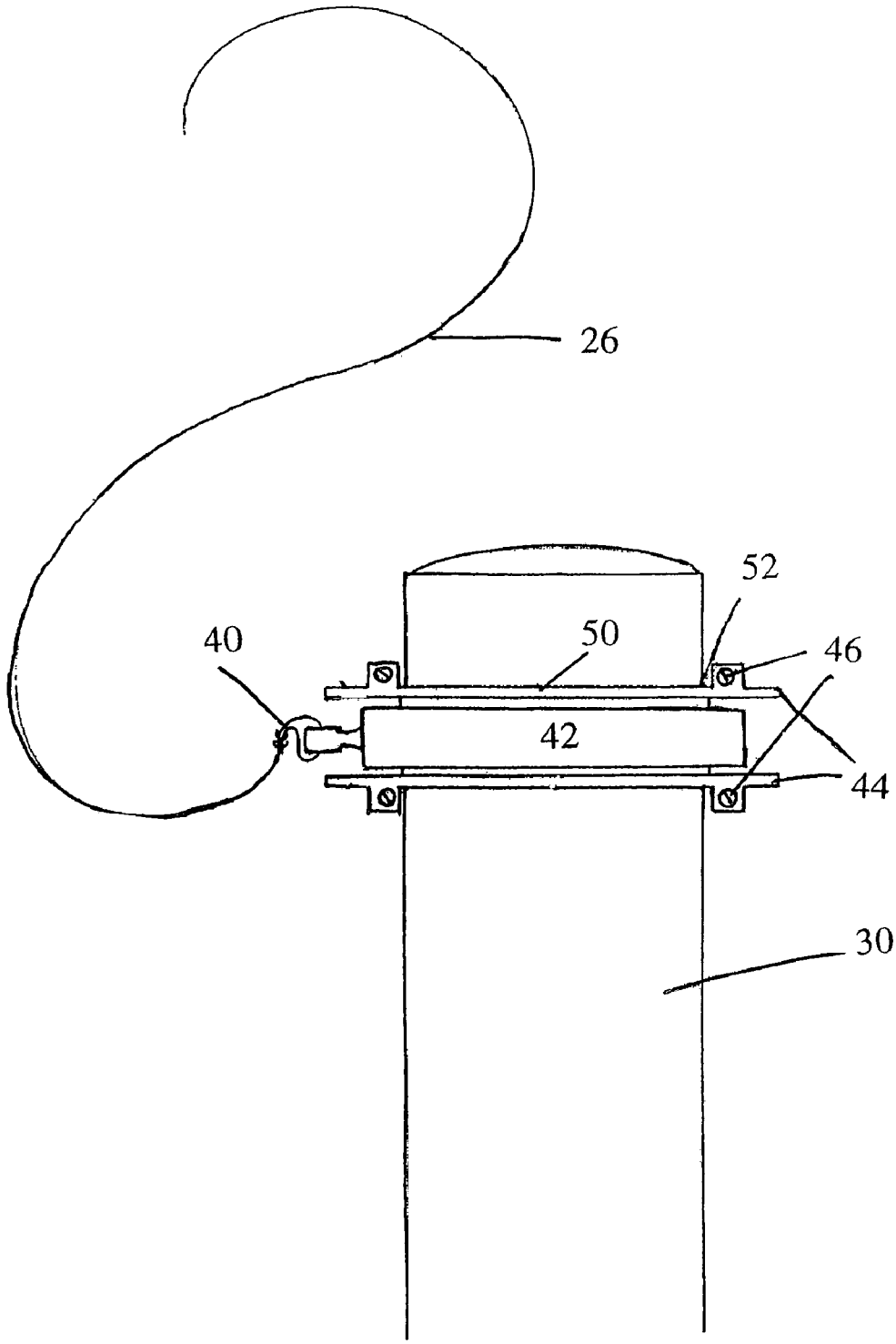
FIG. 6 illustrates the side view of the cylindrical clamp shown in FIG. 5.
Figure 7:
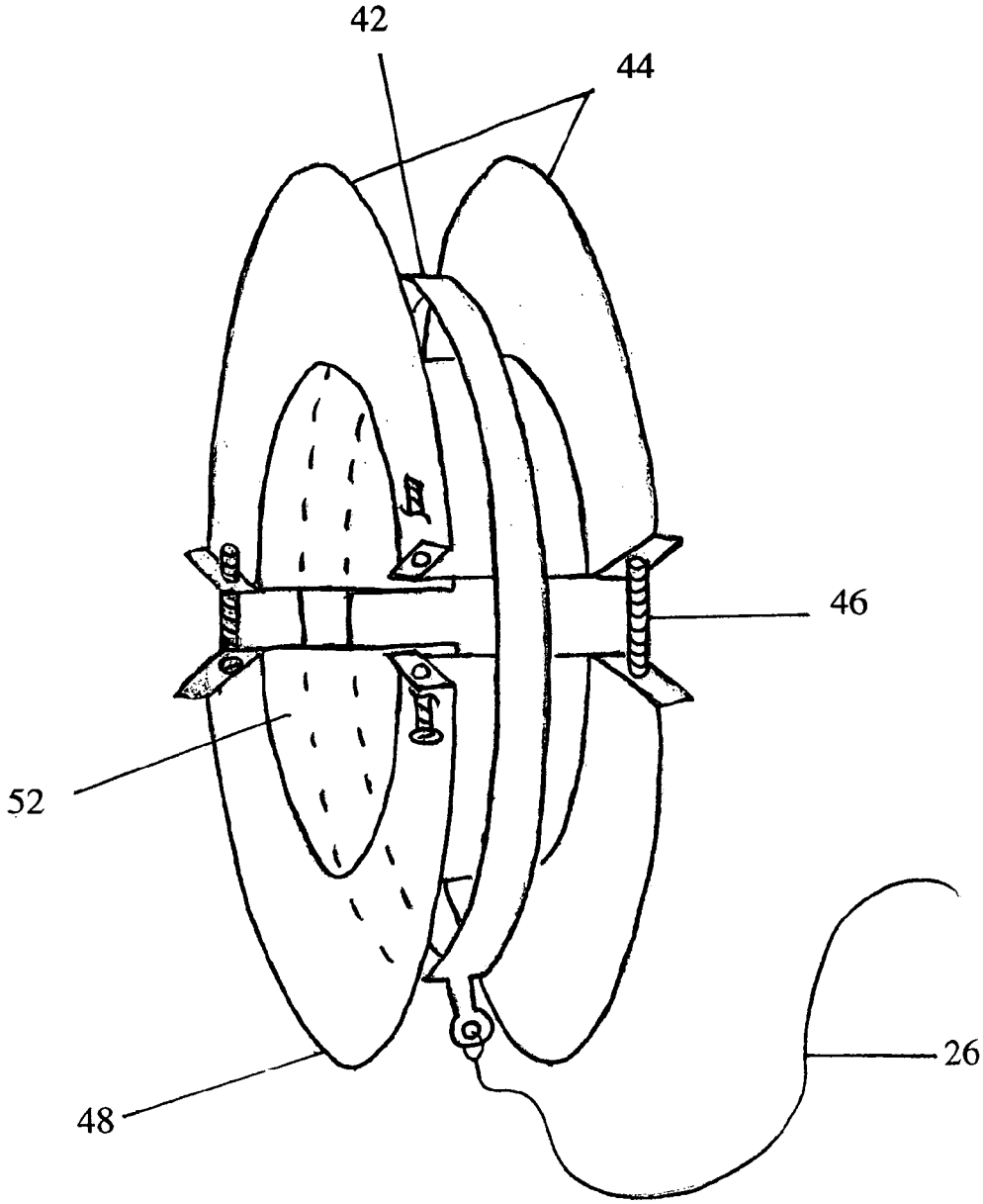
FIG. 7 shows a perspective view of instrument holder.

FIG. 1 shows, inter alia, a clamp-like writing instrument holder 32 that is capable of securing various types of writing instruments. FIGS. 5, 6, and 7 show side elevation and plan views of instrument holder 32. FIG. 7 shows that the instrument holder comprises of a cylindrical clamp 48 and a ring 42. Clamp 48 includes a central cylinder bore 52, flanges 44, and setscrews 46.

FIGS. 5 and 6 show how a writing instrument is secured to the writing instrument holder. In FIGS. 5 and 6, writing instrument 30 is inserted into cylinder 52 of clamp 48 and secured by tightening setscrew 46 mounted on clamp 48. Clamp 48 fits tightly around the shaft of writing instrument 30 and will stay affixed until a user decides to switch writing instruments, say, for example, when the writing instrument runs out of ink.

c. Connection of Tether to Writing Instrument Holder

FIGS. 5 and 6 also show how writing instrument 30 may be connected to tether 26 in a manner that allows writing instrument 30 to rotate in the hand without becoming entangled in tether 26. Clamp 50 has flanges 44 that retain a freely rotating ring 42 encircling the outside of cylinder 52. Tether 26 is attached to ring 42 at attachment point 40, rather than being attached to clamp 50, so that writing instrument 30 may rotate freely without entangling the attaching tether 26.

As noted in our discussion of additional embodiments below, any other means of attaching a writing instrument to a tether that permits the user to switch the writing instrument may be employed. Alternatively, the writing instrument may be permanently attached to the tether. There are many ways of doing this, some of which will be discussed below in the discussion of alternative embodiments.

d. Fasteners on Wristband, Writing Instrument, and Tether

Writing instrument 30 and tether 26 may be secured to wristband 22 when the writing instrument is not in use. In order to accomplish this objective, wristband 22 must include one or more fasteners 24 (such as, for example, a magnet, clip, or hook-and-loop fastener such as VELCRO). Writing instrument 30 and tether 26 must also be capable of being attached to these fastener(s). FIG. 1 illustrates fastener 24 on the wristband.

The manner in which writing instrument 30 and/or tether 26 may be attached to wristband 22 when not in use can vary depending on design and aesthetic preferences. For example, writing instrument 30 may have one or more fasteners 36 (including but not limited to a magnet, clip or hook-and-loop fastener such as VELCRO) wrapped around or otherwise mounted on its shaft so that the writing instrument can be secured to wristband 22 when not in use (by attachment to fastener 24 on the wristband). FIG. 1 illustrates fastener 36 on the writing instrument and fastener 28 on the tether. Note that the particular type of fastener 36 attached to the writing instrument may vary, so long as fastener 36 is compatible with (i.e., may be attached to) fastener 24 affixed to the wristband. Similarly, one or more fasteners 28 (which may or may not be identical to fastener 36) may be wrapped around or otherwise mounted at points along the length of tether 26 so that the tether can be kept from dangling by being secured to wristband 22.

A hook-and-loop fastener, such as VELCRO, is a preferable method for fastening writing instrument 30 and tether 26 to wristband 22. For example, a band of a hook and loop material i.e., VELCRO would envelop the shaft of writing instrument 30 so that it could be easily attached to another band of a hook and loop material i.e., VELCRO on wristband 22. Regardless of the method of attachment used, the utility remains the same: attachment of a writing instrument (and/or its tether) to a wristband.

Figure 8:
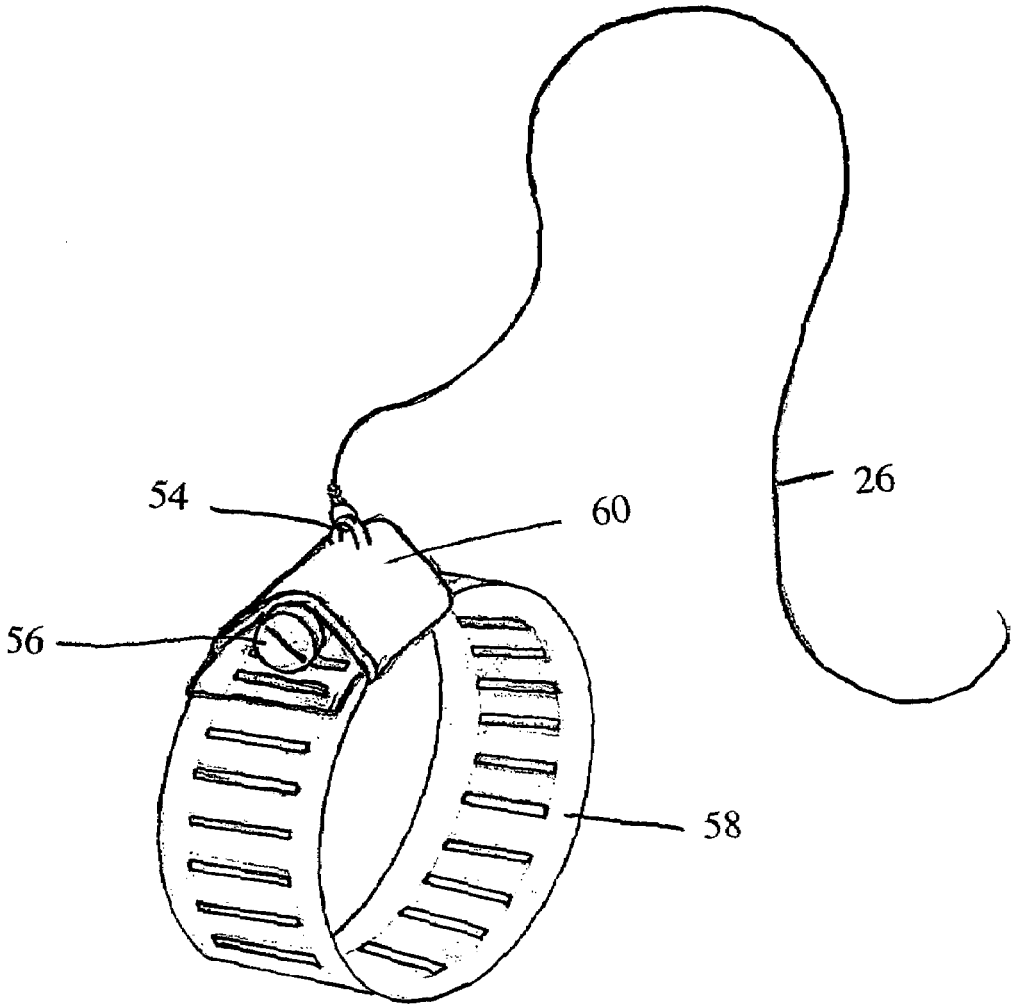
FIG. 8 illustrates another example of a writing instrument holder clamp.

Alternative Embodiments a. Alternative Connections of Tether and Writing Instrument Holder The manner in which tether 26 is connected to the writing instrument holder can vary depending on design, utility, and aesthetic preferences. For example, FIG. 8 shows tether 26 looping through a ring 54 attached to the clamp-like writing instrument holder discussed below. Tether 26 is secured to a ring 54 in any appropriate manner, such as being tied like a noose or stapled or a detachable ring.

Alternatively, as mentioned above, the writing instrument may be permanently attached to the tether in a variety of ways. For example, a hole could be drilled in the writing instrument and the tether inserted through the hole. The tether could then be secured by means of a knot larger than the hole's diameter, or by tying the tether back on itself, or by stapling the tether to itself, et cetera.

Other such appropriate methods of attaching the tether to the writing instrument holder will be obvious to one skilled in the art and will not be discussed here.

b. Alternative Writing Instrument Holder Designs

Any other means of attaching a writing instrument to a tether that permits the user to switch the writing instrument may be employed. For example, the last inch or so of the tether may consist of a length of a hook and loop fasener, i.e., VELCRO, which can be wrapped around the writing instrument shaft and secured to it. Discussed below are two additional examples.

Figure 2:
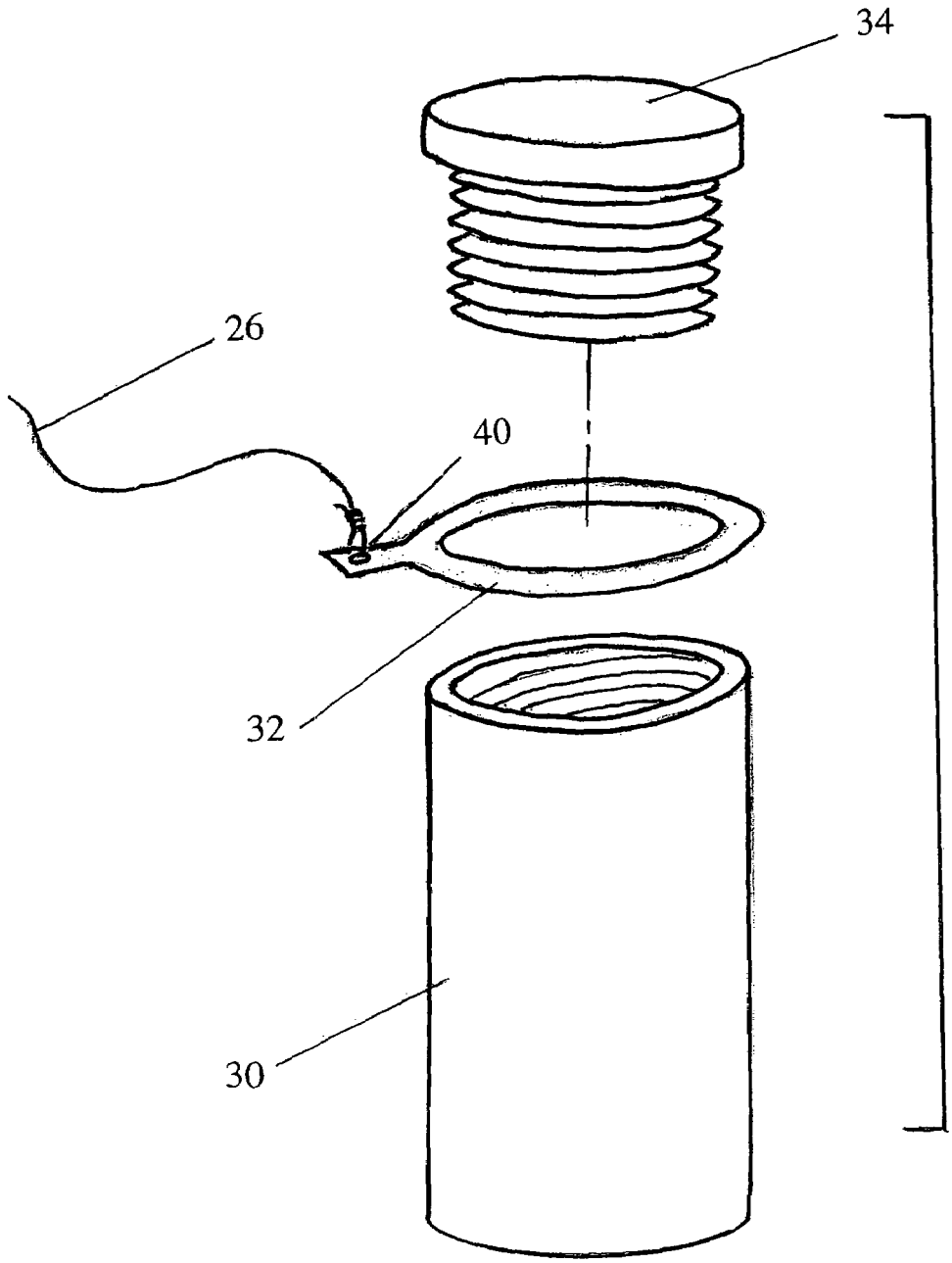
FIG. 2 illustrates a writing instrument holder with a ring attached to a tether such that the writing instrument may be rotated without entangling the tether.

FIG. 2 illustrates another example of a writing instrument holder. A tether is secured at attachment point 40 to a rotating ring 32, which sits between a screw top 34 and the shaft of writing instrument 30. Screw top 34 screws into the shaft of writing instrument 31 and secures rotating ring 32 in place while providing sufficient space for the ring to rotate freely. In this way, the writing instrument may rotate freely without entangling the attaching tether.

FIG. 8 illustrates another example of a writing instrument holder. FIG. 8 shows a clamp-like writing instrument holder that is capable of securing various types of writing instruments. This clamp can be exactly like or similar to a hose clamp, as illustrated in FIG. 8, including a clamp 58 with a screw 56 in housing 60. As screw 56 is tightened, clamp 58 tightens. Grooves on clamp 58 mesh with lands on screw 56, which is held in place by housing 60. As the grooves on the screw spiral when tightened, the writing instrument holder decreases in circumference, constricting about the shaft of a writing instrument and securing it to the holder. This writing instrument holder fits tightly around the shaft of the writing instrument, and will stay affixed until a user decides to switch writing instruments or the writing instrument runs out of ink. Tether 26 may be attached to the writing instrument holder at attachment point 54.

Operation—FIGS. 1, 3 and 4

Wristband 22 is worn on the user's wrist, as shown in FIGS. 3 and 4. FIG. 4 illustrates a user wearing the invention on his or her wrist, with writing instrument 30 and tether 26 attached to wristband 22 by means of fasteners 24 (on the wristband) to 36 (on the writing instrument) and 24 (on the wristband) to 28 (on the tether). The user can easily detach writing instrument 30 from wristband 22 as the need for use of a different writing instrument arises. FIG. 3 illustrates the writing instrument detached from the wristband and in use. As shown in FIG. 3, although the writing instrument can be easily detached from the wristband at 24, tether 26 still secures the writing instrument to the wristband 22, which will prevent misplacement of the writing instrument. When writing instrument 30 is not in use, the user simply reattaches the writing instrument to the wristband, as shown in FIG. 4. Tether 26 may also be secured to the wristband so that it does not dangle annoyingly or the wristband may or may not have a retractable device. FIG. 4 illustrates tether 26 neatly stowed on wristband 22 when the writing instrument is not in use, by means of fasteners 24 (on the wristband) and 28 (on the tether).

Conclusion, Ramifications, Scope

The present invention is designed to keep a writing instrument readily available while walking around in a classroom, warehouse, restaurant or any other place of work or where a writing instrument may be lost or misplaced. A user wears the present invention on his or her wrist. The user can easily detach and reattach the writing instrument from the wristband as needed. Although the writing instrument can be easily detached from the wristband, a tether at all times secures the writing instrument to the wristband, so that the writing instrument cannot be misplaced or lost when dropped. When the writing instrument is not in use, the user simply reattaches the writing instrument (and the tether, if desired) to the wristband. The writing instrument and tether remain neatly attached to the wristband until the writing instrument is needed for future uses.

Although the description above contains many specificities, these should not be construed as limiting the scope of the invention but as merely providing illustrations of some of the presently preferred embodiments of this invention. For example, the writing instrument holder may vary in design and materials, ranging from a clamp to a strip of hook and loop material i.e., VELCRO or any other suitable material or design. The method of attachment of the tether to the writing instrument holder may also vary similarly. For example, the attachment may or may not allow the user to freely rotate the writing instrument without entangling it in the tether, and may vary in material and design as well.

Thus the scope of the invention should be determined by the appended claims and their legal equivalents, rather than by the examples given.

Having described our invention, we claim:

1. A writing instrument holding and retaining device, comprising:

a wristband adapted to be worn around the wrist of a user;

a tether having a first end attached to said wristband;

a writing instrument holder attached to a second end of said tether;

a writing instrument attached to said writing instrument holder such that said writing instrument can rotate with respect to said writing instrument holder;

a first attachment device secured to an outer surface of said wristband;

a second attachment device secured to said writing instrument wherein said writing instrument may be attached to said wristband at a plurality of angles and orientations by attaching said second attachment device to said first attachment device and a third attachment device secured to an outer surface of a central portion of said tether wherein said tether may be attached to said wristband by attaching said third attachment device to said first attachment device to prevent said tether from dangling between said writing instrument and said wristband an attachment device, such as, clamps, clips, or hook-and-loop fastener strips such as VELCRO, etc., by means of which said tether/leash may be attached to said wristband when said writing instrument is not in use so that said tether/leash will not dangle in an annoying manner, and/or using a tether having a predetermined length for a certain users group where these users can simply wrap the tether around his/her wrist and secure the writing instrument to the wristband, and whereby (a) a user may keep his or her writing instrument readily available for use on his/her wrist, and (b) the writing instrument holder device, with its tether/leash, will prevent the user from subconsciously misplacing or losing his or her writing instrument.

* * * * *